United States Patent [19]

Werner et al.

[11] 3,940,831

[45] Mar. 2, 1976

[54] ATTRITION MILL AND METHOD OF FIBROUS WEB FORMATION

[75] Inventors: Edward E. Werner, Oshkosh; Jerome L. Mitchell, Appleton, both of Wis.

[73] Assignee: Kimberly-Clark Corporation, Neenah, Wis.

[22] Filed: Dec. 13, 1974

[21] Appl. No.: 532,370

[52] U.S. Cl. ..... 19/156.3

[51] Int. Cl.[2] ..... D01G 25/00

[58] Field of Search..... 19/88, 89, 155, 156–156.4, 19/144, 148, 82; 241/47, 244, 245, 250, 261.2, 49, 53; 425/80, 81, 82; 156/62.2, 62.4

[56] References Cited

UNITED STATES PATENTS 2,236,472 3/1941 Freydberg et al..... 156/62.2

3,575,472 4/1971 Brewster et al..... 19/156.4 X

*Primary Examiner*—Dorsey Newton

[57] ABSTRACT

Apparatus and method for forming a fibrous batt of controlled thickness and uniformity with fibers flowing from the discs of an attrition mill. The fibers are directed from the outlet of the mill in an air stream in a path of decreasing radius of curvature so that the fibers accelerate toward a collecting screen until they reach a forming chamber communicating the path with the screen. The acceleration of the fibers in the path prevents fiber contact and minimizes fiber contact with walls of the equipment thereby avoiding fiber agglomeration.

12 Claims, 15 Drawing Figures

ATTRITION MILL AND METHOD OF FIBROUS WEB FORMATION

BACKGROUND OF THE INVENTION

Fibrous webs are commonly formed by providing the fibers in fiber form and directing the fibers to a collecting moving screen to achieve a fiber layer of extended length. The fibers employed in such operations are staple fibers and include wood pulp fibers, cotton and synthetic fibers. One apparatus frequently employed in providing the fibers in a form for deposition on a screen is an attrition mill. Such a mill may be employed as to cause the fiber pulp fed to it to be discharged substantially in the form of separated, individual fibers, or the equipment may be so adjusted that the output is in fiber-like pieces. It is not essential to the attainment of good webs that the fibers be actually in individual fiber form if that is, in fact, ever actually accomplished.

The attrition mill is of such a nature, however, discharging from the circumference of relatively rotating discs, that it is difficult to carry the fibers from the mill to the collecting screen without significant agglomeration. In some instances additional equipment such as "whizzers," in effect, small paddles, are operated closely adjacent the collecting screen in an effort to maintain the fibers well separated.

This invention contemplates the provision of a method and apparatus which maintains the fibers emanating from an attrition mill well distributed as they move to the collecting screen.

THE INVENTION

It is a primary object of the present invention to provide a method of acting upon the fibers at the outlet of an attrition mill to accelerate the fibers away from the mill and to continue acceleration of the fibers as they move towards a collecting screen. The acceleration is achieved by carrying the fibers in an air stream through an arcuate path of decreasing radius. The fibers, due to the acceleration, do not clump together, tend to remain free of the wall means defining the arcuate path, and pass through a forming chamber in which their movement is slowed immediately before collection of the fibers in the web form.

It is a particular object of the present invention to provide apparatus which includes an annular path leading from the attrition mill to the forming chamber and collecting screen.

THE INVENTION IN DETAIL

The invention will be more fully understood by reference to the following detailed description and accompanying drawings wherein.

Figure 11:
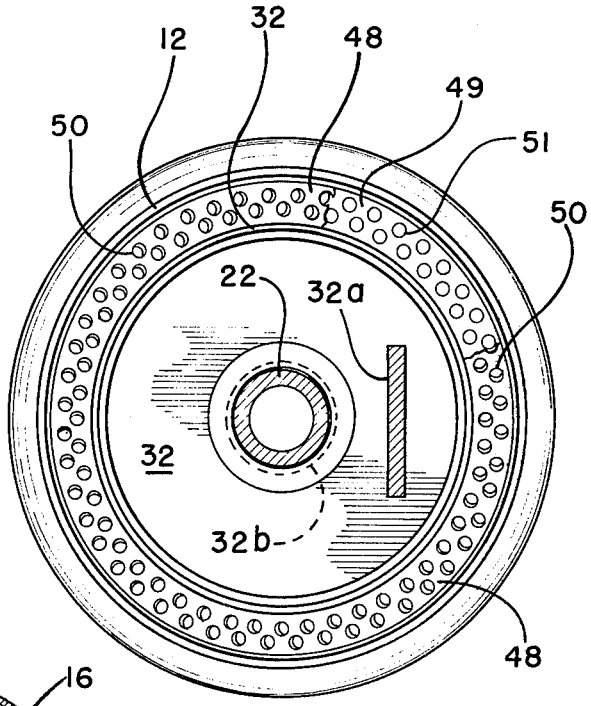
Figure 9:
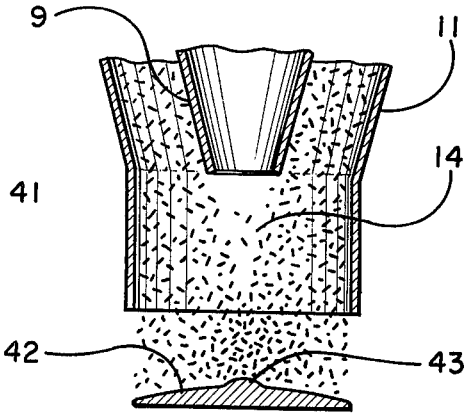
Figure 10:
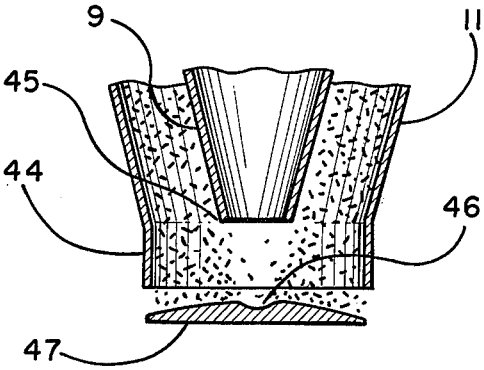

FIGS. 5 and 5*a* through 8 and 8*a* illustrate in plan and front elevation various types of apparatus outlet configurations;

FIG. 9 is an elevational and fragmentary view in section illustrating apparatus for forming a web of centrally raised contour;

FIG. 10 is a view like that of FIG. 9 but illustrating an arrangement for forming a web of centrally depressed contour; and FIG. 11 illustrates a further modification of the apparatus of the invention.

Referring to the drawings more in detail, the numeral 1 designates an inlet conduit through which a flow of fibers 2 in an air stream is directed to the central zone 3 of an attrition mill indicated generally at 4. The attrition mill includes an upper rotatable plate 5 and lower fixed plate 6. Plate 5 has a conventional ribbed insert 7, and plate 6 has a similar ribbed insert 8. In some circumstances the lower plate may be provided to be rotatable also and, in this event, it is useful to provide the driving equipment for the plate 6 beneath it within the interior of the conical confine 9. Under such circumstances the two plates may rotate in opposite directions and, in any event, should be relatively rotatable. However, whether one plate is fixed as in the presently described embodiment or whether both plates rotate, the features of the invention are applicable.

The fibers treated by the circular discs to cause breakup of the incoming material into small fiber particles or individual fibers are discharged peripherally from the discs. In general, this discharge is completely about the circumference of the discs at the zone 10 between the ribbed inserts 7,8. The discs and the conical confine 9 are circumscribed by a casing 11. The casing 11 includes an upper circumferential collar 12 over which air passes as indicated by the arrows to the periphery of the attrition mill discs. The casing 11 is spaced from the conical confine 9 to form an annular path for the flow of fibers and air from the discs toward a receiving screen 13. Immediately above the receiving screen 13 a forming chamber 14 is provided into which the fibers and air stream flowing in the annular path move. The air stream entering the equipment at the collar 12 is induced to move at high velocity by a provision of vacuum conditions on the side of the screen 13 remote from the chamber 14. The vacuum conduit for this purpose is indicated at 15.

Figures 1, 2:
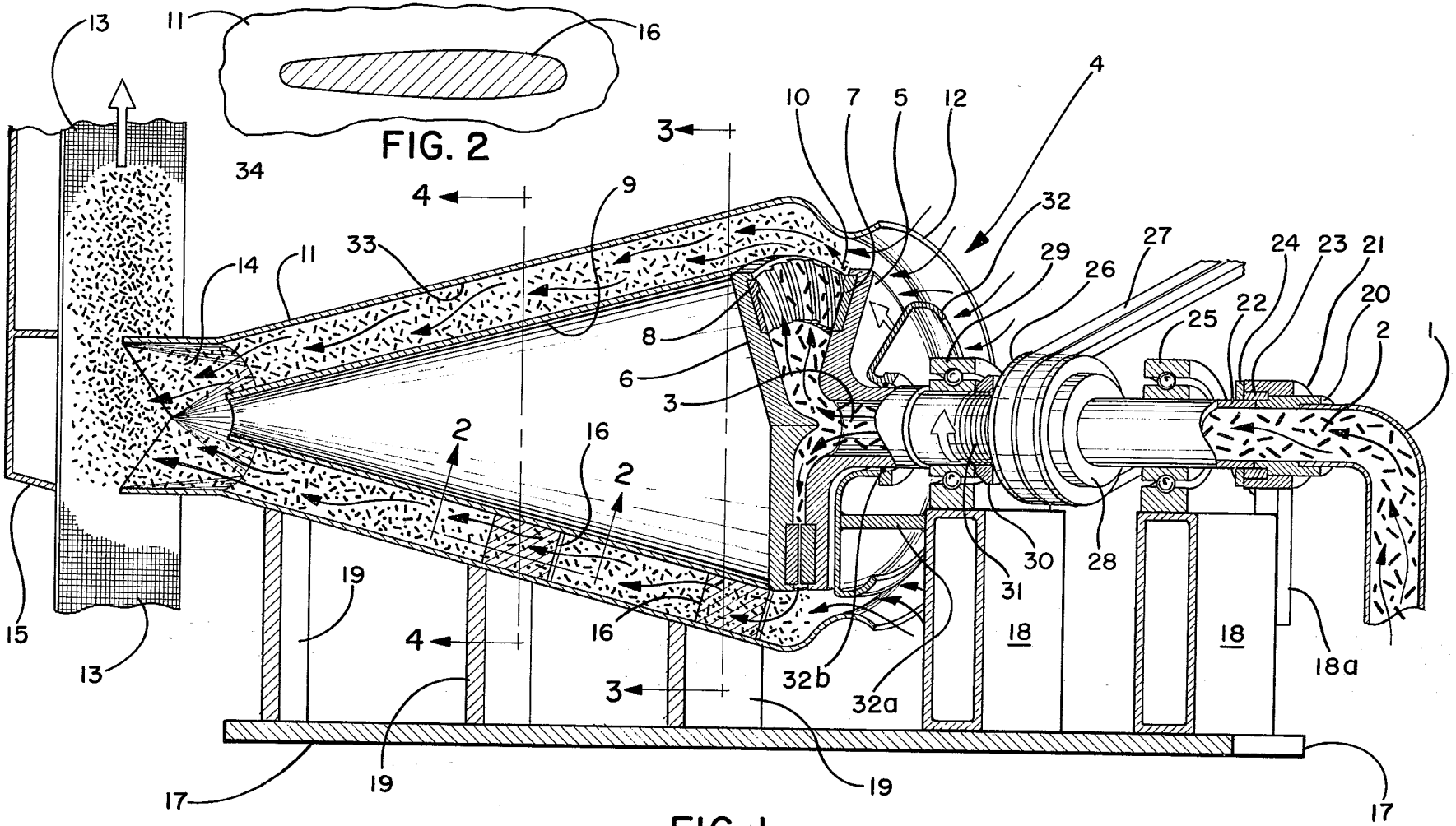
FIG. 1 is a view partially in section and with parts broken away illustrating one embodiment of the apparatus of the invention.
FIG. 2 is a sectional view taken on line 2—2 of FIG. 1 but considerably enlarged.
Figure 3:
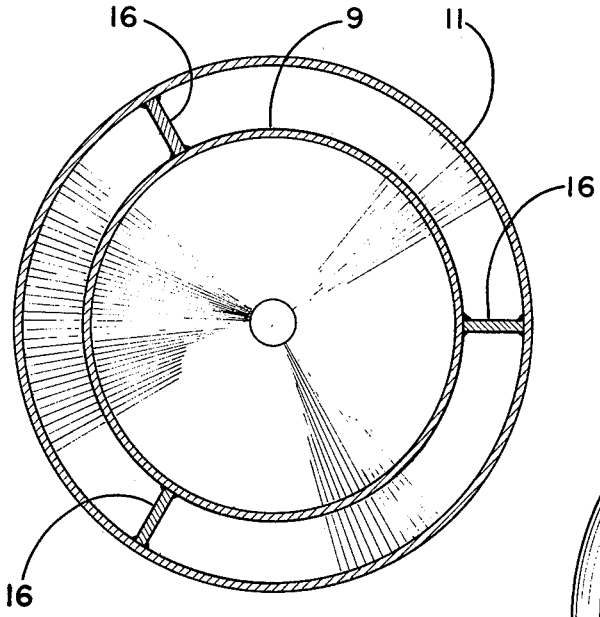
FIG. 3 is a sectional view taken on line 3—3 of FIG. 1.

To retain the conical confine 9 and the casing 11 in fixed spaced relation (FIGS. 2, 3) a trio of thin braces 16 are provided which extend longitudinally with the casing and are shaped to provide for air passage around them, the contour shown being most clearly shown in FIG. 2.

Figure 4:
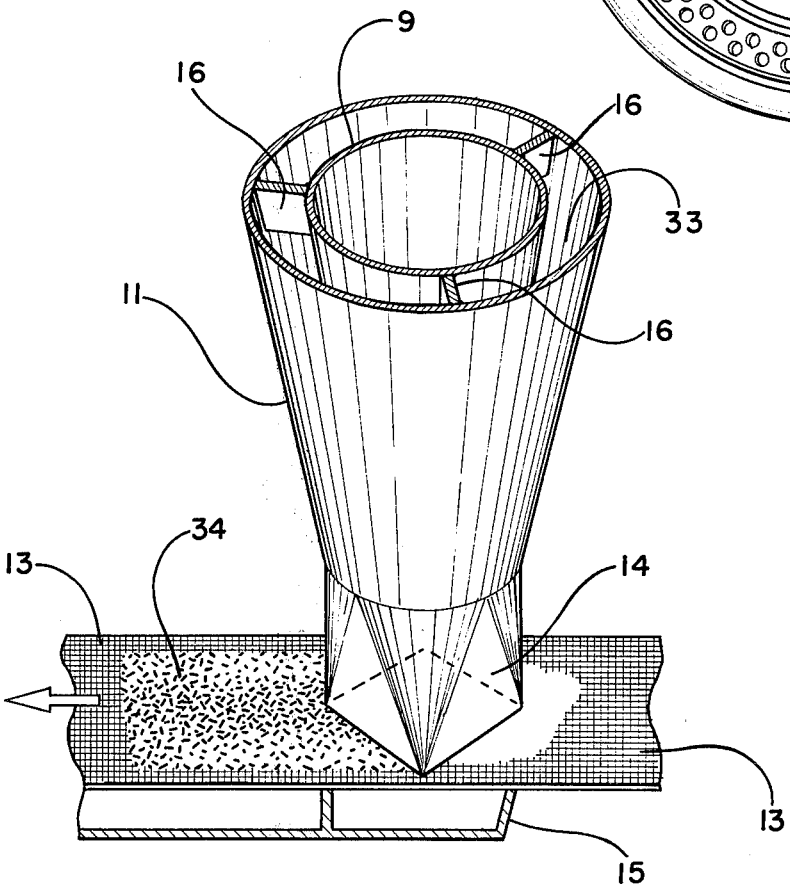
FIG. 4 is a fragmentary view in perspective of a portion of the apparatus of FIG. 1 illustrating particularly the apparatus outlet configuration and a vertical positioning of the apparatus.

Referring to the apparatus now in more detail, a horizontal support 17 has welded to it a plurality of vertical members 18 providing bearing supports for the equipment. As illustrated in FIG. 1, the equipment projects generally horizontally and this is a preferred position as less stresses are imposed upon the supporting bearings and other structural members of the equipment. However, if desired, the casing 11 and its associated equipment may project vertically, in which case the receiving screen 13 will move horizontally as is illustrated by FIG. 4. The casing 11 is itself mounted on a plurality of vertical supports indicated at 19. The supports 19 are of varying length to accommodate the conical nature of the casing 11.

The inlet conduit 2 is fixedly mounted in a collar 20 which is provided with a peripheral support 21 welded to the vertical supporting structure extension 18*a*. The collar 20 receives at its lower end rotating conduit portion 22 which is, in effect, a continuation of the fixed conduit 1. A bearing and sealing element 23 such as a graphite bearing is provided to permit ready rotation of the conduit portion 22. A clamp 24 in the general form of a retaining ring abuts the peripheral support 21 and retains bearing element 23 in place. Support 18 also mounts a ball bearing assembly 25 which encloses the conduit portion 22 over a short length.

A pulley 26 receives V beltings 27 and is itself carried on the conduit portion 22 fixedly to provide for rotation of the conduit portion and the circular disc 5 attached to the lower end of the conduit. The pulley hub is shown at 28.

A second bearing 29 provides further support for the conduit portion and is itself mounted upon a structural support 18. A nut 30 threaded onto the conduit portion over threads 31 serves to retain the left hand bearing 29 in place. An air guide 32 is supported by conduit portion 22. Post 32*a* secured to member 18 fixes the guide against rotation, and element 32*b* provides a seal with the rotatable conduit portion. Air guide 32 defines with the collar 12 of the casing 11 the inlet portion of the annular path for air flow. Guide 32 could be mounted for rotation with the rotatable conduit portion if so desired.

The lower disc 6 of the attrition mill is fixedly carried by the conical confine 9 by being welded thereto peripherally.

The annular passage 33 defined between the casing and conical confine merges into the forming chamber 14. The width and contour of the chamber govern the nature of the fiber deposit. In the arrangement shown in FIGS. 1, 4, 5 and 6, the outlet of the forming chamber 14 is of substantially rectangular configuration. Thus, fiber particles moving through the forming chamber will be deposited uniformly in a generally rectangular configuration with a greater concentration of fibers centrally to provide the web 34 (FIG. 5).

Figure 5:
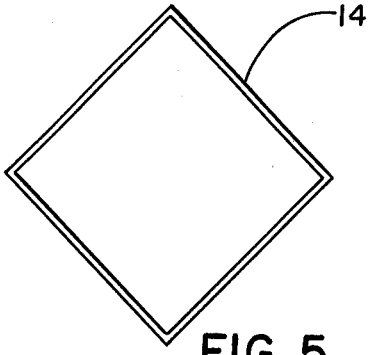
Figure 6:
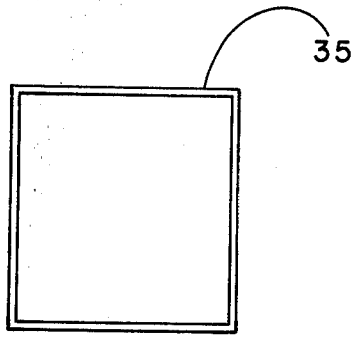
Figure 5A:
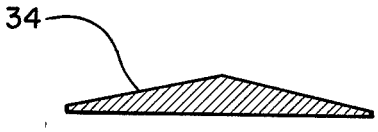
Figure 6A:
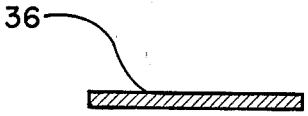

FIGS. 6 and 6*a*, while showing a forming chamber 35 similar in dimensions to that of FIG. 5, have the forming chamber oriented to deposit on the traveling screen a web 36 of uniform thickness overall.

Figure 7:
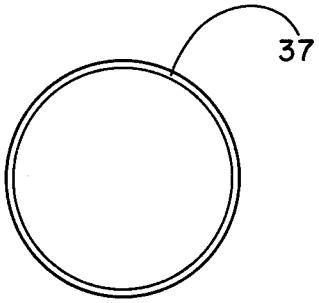
Figure 7A:
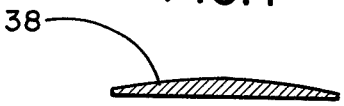

FIGS. 7 and 7*a*, wherein a circular forming chamber 37 is employed, illustrate a contoured batt formation 38 in which the batt surface is arcuate having a greater depth centrally than on the edges.

Figure 8:
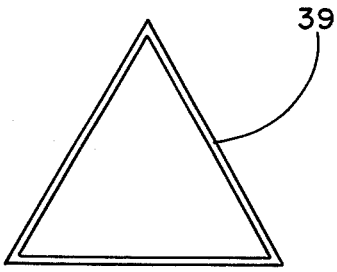
Figure 8A:
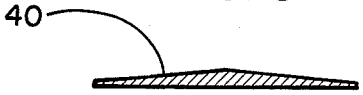

FIGS. 8 and 8*a* illustrate the chamber 39 and batt formation arrangement 40 in which the batt surface is contoured and of greater depth centrally but triangular rather than arcuately shaped in cross-section.

In FIG. 9 the extent of the skirt 41 of the forming chamber 14 below the conical confine 9 extremity is such as to permit a relatively large flow of fiber in the central area of the casing to provide a web 42 which in cross-section has a small protuberant portion 43 (FIG. 9).

In FIG. 10 the extent of the skirt 44 relative to the lower extremity 45 of the confine is less than in FIG. 9. This tends to prevent a large flow of fiber centrally of the casing 11, providing a depression 46 centrally in the web 47.

The flow of air which carries the fibers to the discs of the attrition mill is relatively constant. The flow under the influence of the vacuum may be altered to some degree to speed or slow fiber movement. An alternative approach to modifying the vacuum condition is illustrated in FIG. 11. As shown, casing 12 and air guide 32 may have a pair of cooperable plates 48 and 49 supported therebetween. These plates are relatively rotatable, one overlies the other, and respectively have apertures 50,51 therein. By adjusting the plates and apertures to provide a certain degree of open area through the cooperating plates, the volume of air flow to the annular path 33 may be controlled and readily adjusted.

The fibers in their passage through the annular path of decreasing radius of curvature are carried by a high velocity air stream. Air movement of a speed of about 4000 fpm at the circular inlet causes the fibers to move in the annular path without significant contact with the equipment walls. The fibers are accelerated through the path from the outlet of the discs to the forming chamber. This acceleration provides the fibers in well dispersed form as they enter the forming chamber.

As many apparently widely different embodiments of this invention may be made without departing from the spirit and scope thereof, it is to be understood that I do not limit myself to the specific embodiments thereof except as defined in the appended claims.

We claim:

1. Apparatus for forming a fibrous batt comprising an attrition mill having circular discs which rotate relative to each other and are adapted to act on fibrous material to separate and disintegrate the material, means for feeding an airborne stream of the fibrous material to said attrition mill, a forming chamber and a forming screen, a generally conical casing coaxial with the circular discs and enclosing the discs of the attrition mill and projecting from the area of the discs toward the forming screen and terminating in the forming chamber, a conical confine within the casing spaced from the wall of the casing forming an annular path of decreasing diameter from the attrition mill towards the forming chamber and screen for the conduct of fibers from the mill to the chamber so that fibers leaving the attrition mill discs under the influence of the air stream accelerate in the annular path as they move toward the chamber, said chamber being of such dimension that fibers passing therethrough to the screen from the annular path are slowed in their movement.

2. Apparatus for forming a fibrous batt as claimed in claim 1 in which the forming chamber has a rectangular cross-section facing the forming screen.

3. Apparatus for forming a fibrous batt as claimed in claim 1 in which the forming chamber has a circular cross-section facing the forming screen.

4. Apparatus for forming a fibrous batt as claimed in claim 1 in which the forming chamber has a triangular cross-section facing the forming screen.

5. Apparatus for forming a fibrous batt as claimed in claim 1 in which the conical confine terminates well above the lower extremity and outlet of the conical casing so that the flow of fibers in the annular path tends to concentrate centrally of the forming chamber below the conical confine and is greater in the central area of the forming chamber outlet.

6. Apparatus for forming a fibrous batt as claimed in claim 1 in which the confine terminates closely to the lower extremity and outlet of the conical casing so that the flow of fibers in the annular path tends to be less centrally of the forming chamber below the conical confine and is less also at the outlet of the forming chamber to the forming screen.

7. The method of producing a web of fibers which comprises the steps of subjecting a fibrous material to an attrition mill to provide a flow of substantially individual fibers from the mill, conveying the fibers in an air stream from the outlet of the mill in an annular path of decreasing radius of curvature so that the fibers accelerate in their passage through the path, collecting the fibers from the air stream and decreasing the velocity of the fibers immediately before collecting the fibers, said collecting of the fibers involving contacting a forming screen with said fiber containing air stream so that the air passes through said forming screen while fibers are collected on the screen in the form of a layer.

8. The method of producing a web of fibers as claimed in claim 7 in which the air stream carrying the fibers enters the path of decreasing radius of curvature at a speed of at least about 4000 fpm.

9. The method of producing a web of fibers as claimed in claim 7 in which the fibers immediately prior to collection from the air stream are formed into a configuration which is rectangular in cross-section, and moving the collection screen diagonally of the configuration to attain a web of greater fiber depth centrally than laterally.

10. The method of producing a web of fibers as claimed in claim 7 in which the fibers immediately prior to collection from the air stream are formed into a configuration which is circular in cross-section, and moving the collection screen transversely of the configuration to attain a web of fibers which is of greater depth centrally than laterally and which is arcuate in cross-section.

11. The method of producing a web of fibers as claimed in claim 7 in which the fibers immediately prior to collection from the air stream are formed into a configuration which is triangular in cross-section, and moving the collection screen transversely of the configuration to attain a web of fibers which is of greater depth centrally than laterally and which is triangular in cross-section.

12. The method of producing a web of fibers as claimed in claim 8 in which the volume of air entering the path of decreasing radius of curvature is adjusted.

* * * * *